United States Patent [19]

McIngvale, Jr. et al.

[11] Patent Number: 4,918,582

[45] Date of Patent: Apr. 17, 1990

[54] MATING TERMINAL AND SOCKET ASSEMBLY

[75] Inventors: James D. McIngvale, Jr., Hernando; Margaret A. Self, Lake Cormorant, both of Miss.

[73] Assignee: F.L. Industries, Inc., Livingston, N.J.

[21] Appl. No.: 167,561

[22] Filed: Mar. 14, 1988

Related U.S. Application Data

[63] Continuation-in-part of Ser. No. 133,795, Dec. 16, 1987, abandoned.

[51] Int. Cl.[4] ..... F21S 3/02

[52] U.S. Cl. ..... 362/217; 362/218; 362/294

[58] Field of Search ..... 362/217, 219, 222, 223, 362/224, 225, 226, 200, 218, 294; 439/226, 237, 241, 485

[56] References Cited

U.S. PATENT DOCUMENTS

| | | | |
|---|---|---|---|
| 2,338,835 | 1/1944 | Bryant | 362/217 |
| 2,374,032 | 4/1945 | Mueller | 362/217 |
| 2,626,976 | 1/1953 | Howenstine | 439/237 |
| 2,705,310 | 3/1955 | Hodge . | |
| 2,769,156 | 10/1956 | Caplis et al. . | |
| 2,847,561 | 8/1958 | Huerkamp et al. | 439/226 |
| 2,911,609 | 11/1959 | Burtt et al. . | |
| 3,035,164 | 5/1962 | Thomas et al. | 439/237 |
| 3,255,345 | 6/1966 | Chadwick | 362/218 |
| 3,320,466 | 5/1967 | Ayres et al. . | |
| 3,353,140 | 11/1967 | Johnson | 439/237 |
| 3,360,765 | 12/1967 | Stranget et al. . | |
| 3,437,802 | 4/1969 | Dntraton | 362/218 |
| 3,515,931 | 6/1970 | Takakuwa . | |
| 3,601,775 | 8/1971 | Longnecker et al. | 339/176 |
| 3,685,003 | 8/1972 | Watt | 439/226 |
| 3,720,907 | 3/1973 | Asick | 339/176 MP |
| 3,788,560 | 1/1974 | Hough et al. | 362/217 |
| 3,832,540 | 8/1974 | Roth | 439/237 |
| 3,906,217 | 9/1975 | Lackore | 439/226 |
| 3,961,216 | 6/1976 | Edwards | 313/51 |
| 4,074,122 | 2/1978 | Moore | 362/223 |
| 4,195,249 | 3/1980 | Ariga et al. | 313/493 |
| 4,288,846 | 9/1981 | Fletcher et al. | 362/217 |

*Primary Examiner*—Ira S. Lazarus
*Assistant Examiner*—Sue Hagarman
*Attorney, Agent, or Firm*—John G. Gilfillan; Elliot M. Olstien; Raymond J. Lillie

[57] ABSTRACT

A mating terminal and socket assembly comprising a quartz lamp with at least one terminal means connected to and extending outwardly from the quartz lamp. The terminal means is inserted into a socket means adapted to receive and grip the first terminal means. The socket means is preferably movable and connected to an electrically conductive means such as a wire. This mating terminal and socket assembly can be contained within the housing of a luminaire fixture. This invention also relates to a quartz lamp comprising a bulb having first and second end portions, and first and second end terminal means extending outwardly from the end portions of the bulb.

22 Claims, 6 Drawing Sheets

MATING TERMINAL AND SOCKET ASSEMBLY

This application is a continuation-in-part of application Ser. No. 133,795, filed Dec. 16, 1987, now abandoned.

This invention relates to an assembly of a mating elelctrical terminal and socket. More particularly, this invention relates to a mating terminal assembly which includes a quartz lamp, with said quartz lamp being contained within a luminaire housing.

Terminal assemblies for lamps contained within luminaires are well-known in the art. A commonly-used assembly presently used in the art comprises a lamp such as a gaseous discharge lamp, quartz lamp or quartz halogen lamp in the form of a tubelike bulb. Rounded concave terminals are located at opposite ends of the bulb. These terminals each mate with convex terminals in the luminaire housing. The convex terminals in the luminaire housing are mounted on tensioned springs. When one wishes to insert the lamp into the luminaire housing, one must push the concave terminals, one at a time, against the convex terminals and the spring holding the convex terminal. After the lamp has thus been inserted into the luminaire housing, the tensioned springs and convex terminals press against each of the concave terminals, thus holding the lamp in place between the two spring-biased convex terminals.

Although this arrangement and method of insertion of a lamp into a luminaire housing is designed to hold the lamp securely within the housing, certain difficulties have been encountered. For example, the insertion of the lamp between the two spring biased terminals requires the exertion of a considerable degree of force against each of these terminals in order to insure proper insertion of the lamp. If insufficient force is applied during the insertion procedure, the lamp may pop out from the spring biased convex terminals. This could result in breakage of the lamp, thus requiring one to procure a replacement lamp for installation. In addition, if an improperly inserted lamp breaks during the insertion procedure, the installer risks the possibility of being injured by broken glass from the lamp. If a poor connection is made between the terminals, the concave and convex terminals will become damaged over a period of time. In addition, such lamps generate a considerable amount of heat (e.g., operational temperatures up to 150° C. to 200° C. or more at the junctions of the terminals, and temperatures up to 500° C. in the center of the quartz lamp) which requires a socket construction that is able to withstand such heat, such as a metal socket housing means.

Applicants have invented a new quartz lamp which can be used in conjunction with a mating terminal and socket assembly which overcomes the disadvantages mentioned above. The quartz lamp of Applicants' invention comprises a bulb having first and second end portions, said bulb also including a filament and first and second end terminal means, also known as male terminal means extending outwardly from said end portions of said bulb and electrically connected to said filaments of said bulb. In a preferred embodiment, the first and second end terminals are of a flat, bladelike configuration. In a most preferred embodiment, the first and second end portions of the bulb of the quartz lamp includes respectively a first and second heat dissipating collar means, with first and second end terminal means extending outwardly from said first and second collar means. In a preferred embodiment, a portion of each collar means is adjusted to each of said terminal means and includes an enlarged head portion. The collar means are preferably made of a heat dissipating ceramic material. The outwardly extending terminal means serve to dissipate the heat generated by the quartz lamp when the lamp is in operation. The collar means provide for further dissipation of heat, as do the enlarged head portions of the collar means. This enables the use of an inexpensive surrounding housing material for the mating socket, such as a plstic. This quartz lamp construction also provides for greater spacing of the lamp bulb itself from a socket means while allowing for proper operation of the lamp at a lower operating temperature for the socket means. Applicants have surprisingly found that such a quartz lamp provides for a better connection between the lamp and a mating socket even though the mating socket will have a lower operating temperature.

Applicants have also invented a mating terminal and socket assembly that requires less time and effort to install, and is also safer to install, while at the same time maintaining the proper electrical contact necessary to operate a lamp, as well as a lower operating temperature for the socket. The apparatus of Applicants' invention comprises a quartz lamp containing a filament therein and at least one terminal means connected to and extending outwardly from said lamp and electrically connected to the filament. The terminal means serves the dissipate heat generated by the quartz lamp. The assembly also includes at least one prong socket means, or female socket terminal, adapted for receiving and gripping said at least one terminal means, and electrically conductive means connected to the prong socket means. The prong socket may be movable. Movement of the prong socket is in response to expansion and contraction of the quartz lamp. The terminal means may also be movable within the prong socket during expansion and contraction of the quartz lamp. The electrically conductive means may be a wire. In a preferred embodiment, the apparatus comprises two terminal means and two prong socket means, and the lamp is a quartz halogen lamp. A die cast heat barrier comprising two walls parallel to the end of the quartz lamp and to each other, and a U-shaped panel perpendicular to said first two walls and to said quartz lamp, is also included. The U-shaped panel also serves to accommodate the quartz lamp.

The mating terminal and socket assembly preferably further comprises at least one housing having at least one opening. The housing contains at least said at least one prong socket means. The prong socket means may be movable within the housing. The housing may be made of a plastic material. The housing may also contain a portion of the electrically conductive means, such as a wire.

In a preferred embodiment, the quartz lamp comprises an elongated bulb preferably having two ends. The terminal means is preferably of a flat, bladelike configuration. Preferably, the quartz lamp has at least one collar made of a ceramic material, and is attached to an end of the quartz lamp by fitting over the quartz lamp bulb at a first end of the collar. The collar also has a second end which is adjusted to the terminal, said terminal extending outwardly from said collar. The collar is thus disposed between the terminal and an end of the the lamp bulb. The collar also serves to dissipate heat generated by the quartz lamp. The second end of the collar also may be an enlarged head portion adjusted to the terminal and distal from the lamp. In a preferred embodiment, the socket comprises a horizontal base portion and a pair of prongs extending upwardly from the horizontal base portion. Each of said prongs has a first portion extending upwardly and inwardly angularly from an edge of said horizontal base portion, a second portion extending vertically upwardly from said first portion, and a third portion extending upwardly and angularly outwardly from said second portion. Applicants' invention is also directed to a luminaire comprising a housing, a lens attached to the front of said housing, and the apparatus described above, which is contained within the housing.

In a preferred embodiment, the luminaire also includes a reflector. The reflector panel, which serves to dissipate heat generated by a lamp when at least one lamp terminal is inserted into or connected with at least one socket terminal to form at least one electrical connection, comprises a base panel for mounting within a luminaire housing, and at least one upwardly extending U-shaped panel located inward from the point of connection between said at least one lamp terminal and said at least one socket.

In a mating terminal and socket assembly as described above, the maintenance of temperatures of the assembly and of the luminaire which will insure reliable operation of the assembly and the luminaire, is essential. In such a mating terminal and socket assembly, the center of the quartz lamp may reach temperatures of up to 500° C. When a collar is located at an end of the quartz lamp, the collar is cemented to the end of the quartz lamp. The temperature of the point of attachment of the collar to the quartz lamp generally should not exceed 350° C. in order to maintain a firm bond of the collar to the quartz lamp. When a plastic prong socket housing is used, the temperature of the prong socket housing generally should not exceed 200° C. when the male terminal is inserted into the prong socket, or female socket terminal. In order to insure reliable operation of the male terminal and female socket terminal, the temperature of the connection between the male terminal and female socket terminal generally should not exceed 150° C. In accordance with the present invention, the male terminal extends outwardly from the end of the quartz lamp to a distance which will maintain temperatures of the connection between the male terminal and the female socket terminal, the prong socket housing, the assembly, and a luminaire containing the assembly, as hereinabove described to provide for the reliable operation of the lamp, the assembly, and the luminaire. The distance from the end of the lamp to which the male terminal extends may vary according to the size of the quartz lamp, wattage of the quartz lamp, heat generated by the quartz lamp, and size of the luminaire.

Figure 1:
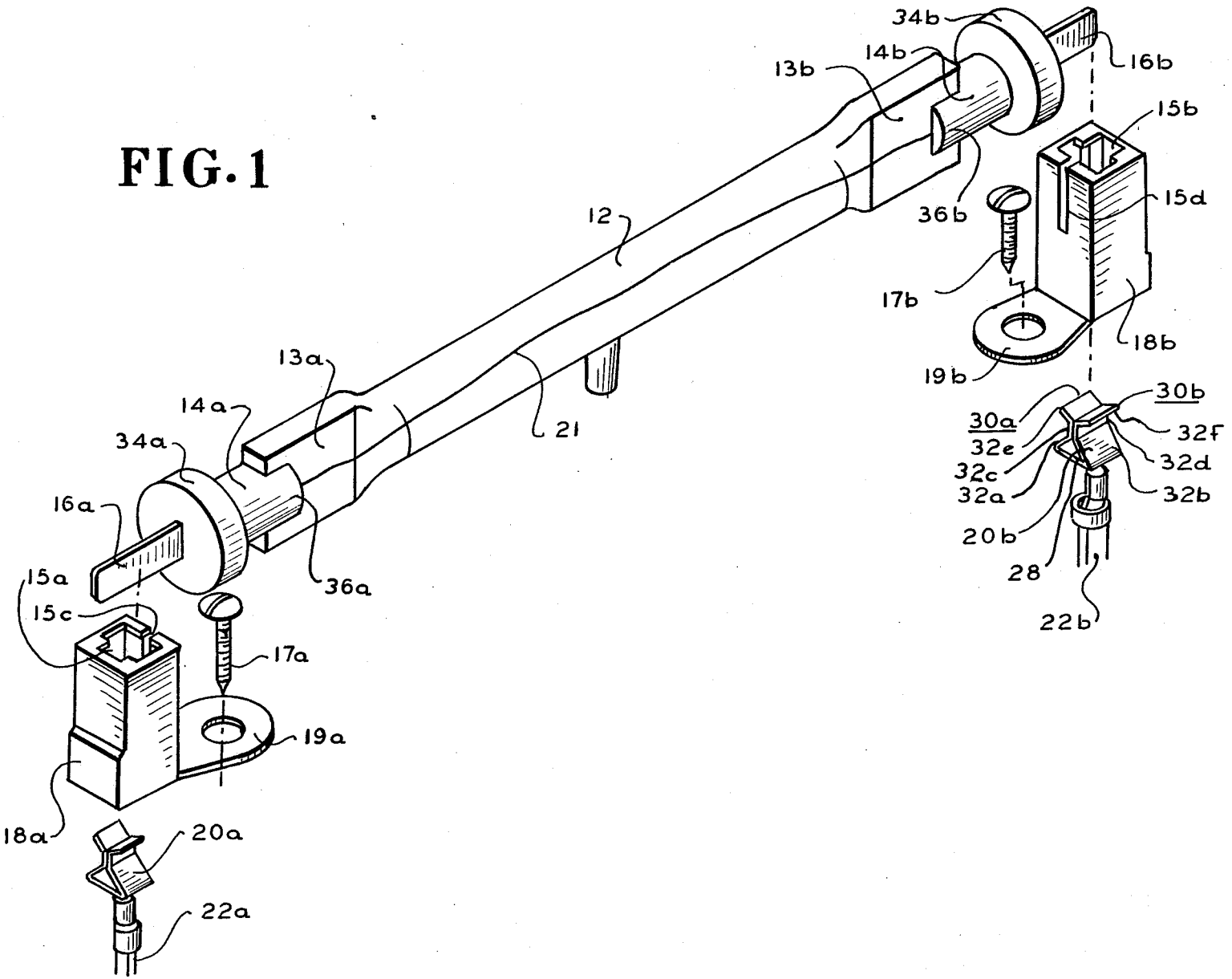
FIG. 1 is an exploded view of an embodiment of the quartz lamp and of the mating terminal and socket assembly of the present invention.
Figure 2:
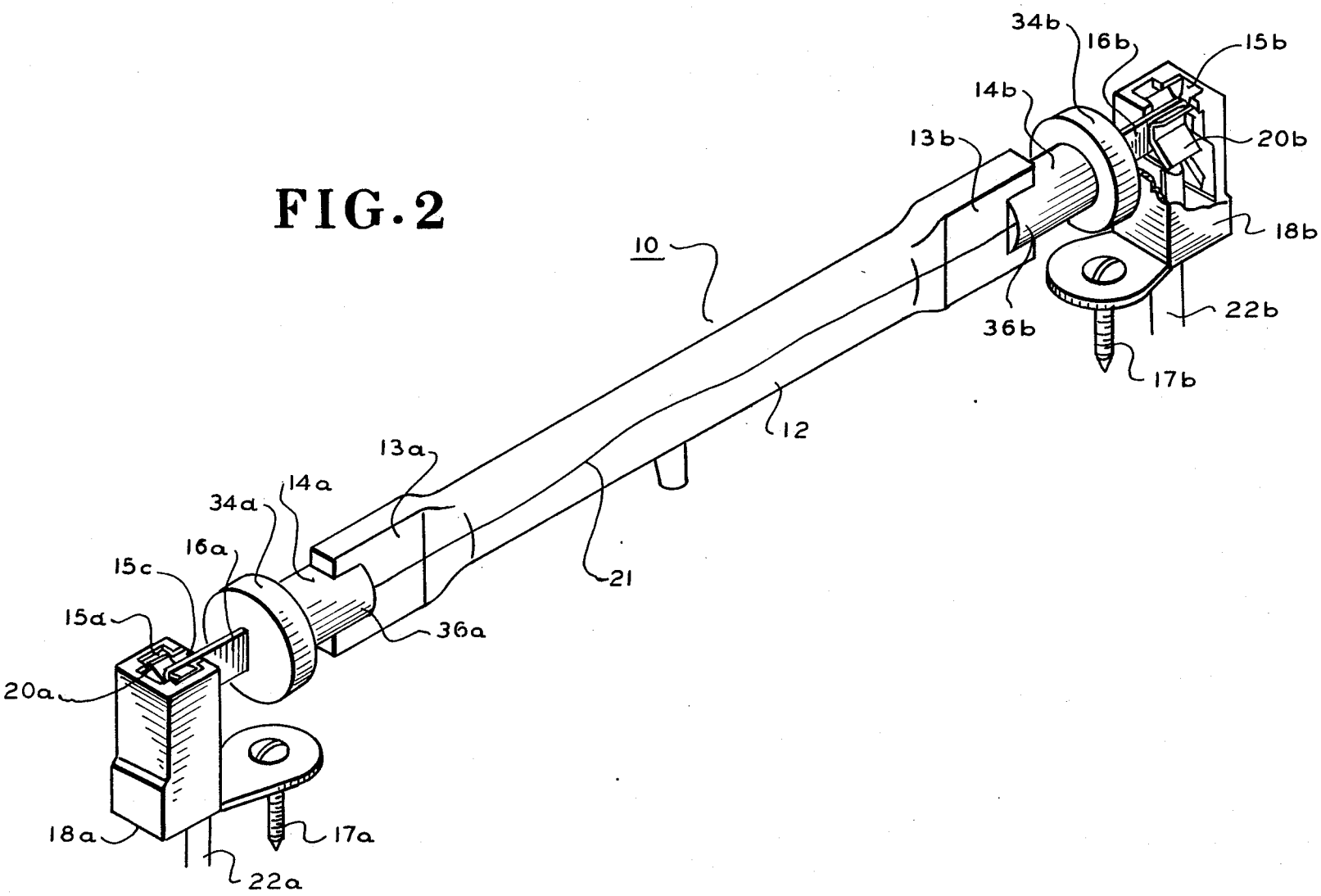
FIG. 2 is an elevated and partially cut-away view of an assembled embodiment of the mating terminal and socket assembly.

Referring now to the drawings, a preferred embodiment of the mating terminal and socket assembly 10 comprises a quartz lamp in the form of a bulb 12. Bulb 12 also has flattened end portions 13*a* and 13*b* located at opposite ends. Next to the flattened portions 13*a* and 13*b* are collars 14*a* and 14*b*, respectively, which are made of a ceramic material. In this embodiment, collar 14*a* fits over flattened end portion 13*a*, and collar 14*b* fits over flattened portion 13*b*. Collars 14*a* and 14*b* may be made of a non-conductive ceramic material such as procelain. Extending outwardly from collars 14*a* and 14*b* are blade terminals 16*a* and 16*b*, respectively. Located proximal to blade terminal 16 is a head portion 34*a* of collar 14*a*, and located proximal to blade terminal 16*b* is head portion 34*b* of collar 14*b*. Head portions 34*a* and 34*b* are also located distal to flattened end portions 13*a* and 13*b* of bulb 12, respectively. The collars 14*a* and 14*b* have forked portions 36*a* and 36*b* whit fit over the flattened end portions 13*a* and 13*b*, respectively, of bulb 12. The collars 14*a* and 14*b* are usually bonded to flattened end portions 13*a* and 13*b* by cement. Blade terminals 16*a* and 16*b* are each connected to filament 21 which runs through bulb 12, flattened portions 13*a* and 13*b*, and collars 14*a* and 14*b*.

In order to make a proper electrical contact for operation of the lamp, one inserts blade terminals 16*a* and 16*b* into wedge sockets 20*a* and 20*b*, respectively. Attached to wedge sockets 20*a* and 20*b* are wires 22*a* and 22*b*. Wires 22*a* and 22*b* may be contained within a fixture such as a luminaire housing 24, and run from housing 24 to an electrical power source (not shown). Upon receiving blade terminals 16*a* and 16*b*, wedge sockets 20*a* and 20*b* serve to grip blade terminals 16*a* and 16*b* in order to maintain contact with blade terminals 16*a* and 16*b*. In the embodiment shown, wedge sockets 20*a* and 20*b* have a triangular bottom portion formed by a base and two prongs, a central portion wherein the prongs meet and touch each other, and an upper portion wherein the prongs are outwardly flared.

Blade terminals 16*a* and 16*b* extend outwardly from collars 14*a* and 14*b* so as to insure reliable operation of the blade terminals 16*a* and 16*b*, wedge sockets 20*a* and 20*b*, as well as insuring that the wedge terminal housings 18*a* and 18*b* do not reach too great a temperature. When the blade terminals 16*a* and 16*b* are inserted into wedged sockets 20*a* and 20*b*, thus operating the quartz lamp, the temperature of the contact points of forked portion 36*a* of collar 14*a* with bulb 12, and of the contact points of forked portion 36*b* of collar 14*b* with bulb 12, must not exceed 350° C. The temperature of the wedge socket housings 18*a* and 18*b* must not exceed 200° C., and the temperature of the contact points of blade terminal 16*a* with wedge socket 20*a* and of blade terminal 16*b* with wedge socket 20*b* must not exceed 150° C. in order to insure reliable operation of the quartz lamp and the terminals. In an illustrative embodiment, blade terminals 16*a* and 16*b* extend outwardly from collars 14*a* and 14*b* for about ½ inch. Blade terminals 16*a* and 16*b* also may be, for illustrative purposes, about 3/16 inch wide and about 0.020 inch thick.

It can also be seen that wedge sockets 20*a* and 20*b*, as well as small portions of wires 22*a* and 22*b*, are contained in wedge socket housings 18*a* and 18*b*, said wedge socket housings having openings 15*a* and 15*b*, respectively, at the top of the socket housings, and slits 15c and 15d, respectively, at the sides of the socket housings, into which blade terminals 16a and 16b are inserted prior to insertion into wedge sockets 20a and 20b. Wedge socket housings 18a and 18b may be fixed within a lighting fixture such as a luminaire housing 24 by screws 17a and 17b which are inserted through openings 19a and 19b of wedge terminal housings 18a and 18b and into the rear of luminaire housing 24. In preferred embodiment, wedge terminal housings 18a and 18b may be made of a plastic material. A preferred plastic material is Ryton, a product of Phillips Petroleum.

Wedge sockets 20a and 20b are also slightly movable within wedge socket housings 18a and 18b, respectively. The wedge sockets 20a and 20b provide "floating terminals" that are movable in response to expansion and contraction of the quartz lamp 12. This expansion and contraction of the quartz lamp is in response to heating and cooling of the quartz lamp as it is turned on and off. Blade terminals 16a and 16b also may move within wedge sockets 20a and 20b as quartz lamp 12 expands and contracts. The ability of the wedge sockets 20a and 20b to move in response to expansion and contraction of quartz lamp 12 prevents arcing and pitting of the terminals and thus helps to prolong the life of the terminals.

Each of said wedge sockets 20a and 20b has a flat horizontal portion 28 and a pair of upwardly extending prongs 30a and 30b. Each of said prongs 30a and 30b has a first portion 32a and 32b extending upwardly and inwardly angularly from an edge of flat horizontal portion 28, a second portion 32c and 32d extending vertically upwardly from said first portion 32a and 32b, respectively, and a third portion 32e and 32f extending upwardly and angularly outwardly from second portion 32c and 32d. It can be seen from the drawings that the resulting configuration of wedge sockets 20a and 20b is that of a "Y" shape on top of a triangle. It also can be seen that it is in the second portions 32c and 32d of wedge sockets 20a and 20b that serve to grip blade terminals 16a or 16b when the blade terminals 16a and 16b are inserted into the wedge sockets 20a and 20b. When wedge sockets 20a and 20b do not engage blade terminals 16a and 16b, second portions 32c and 32d of prongs 30a and 30b touch each other. In this way, there will be no distortion of blade terminals 16a and 16b, or of wedge sockets 20a and 20b during operation of the quartz lamp, and the wedge sockets 20a and 20b also will not be distorted when there is no blade terminal inserted in them. In an alternative embodiment, the flat horizontal portion 28 of wedge sockets 20a and 20b is absent and prongs 30a and 30b are directly connected to a wire.

Figure 3:
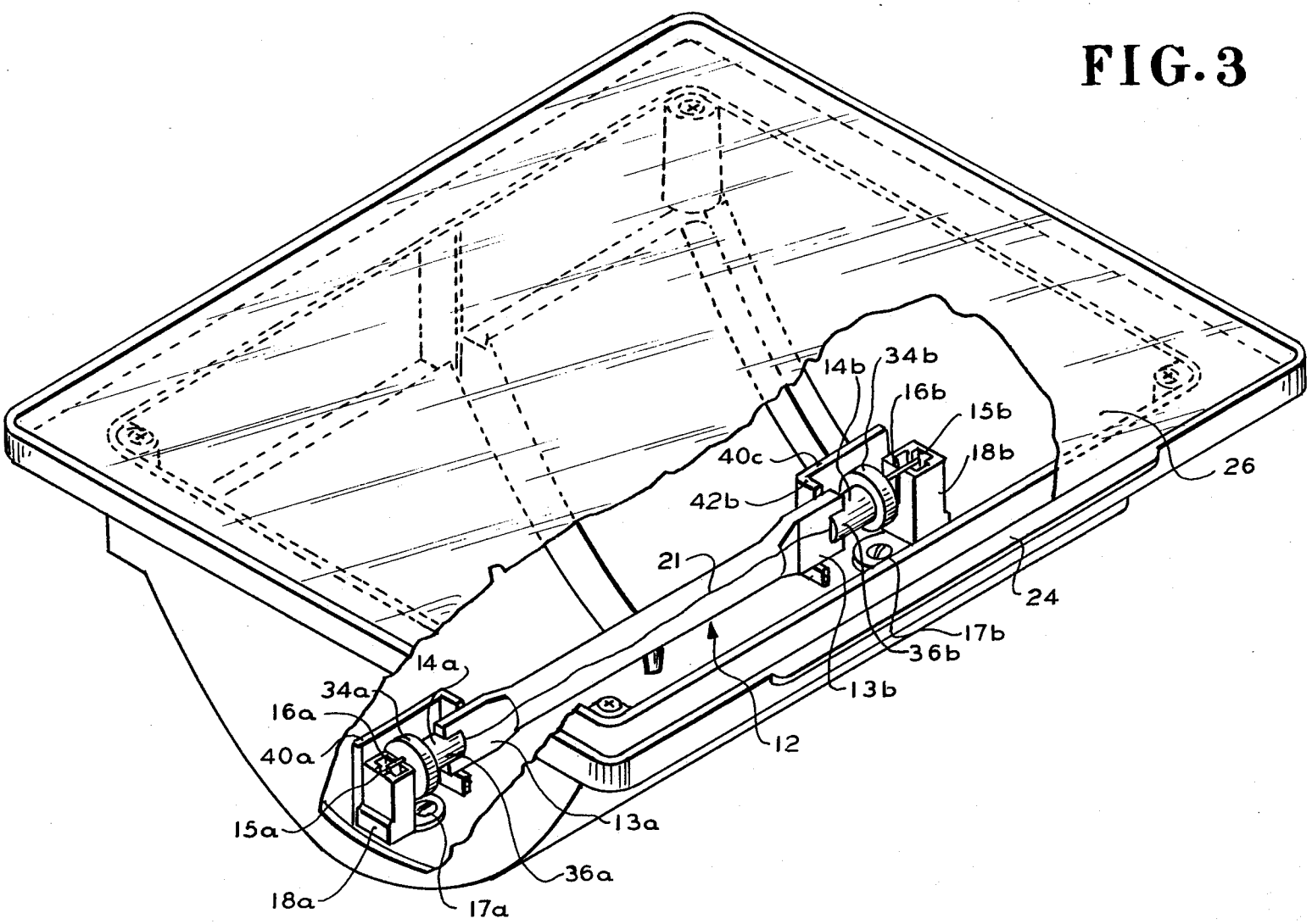
FIG. 3 is an isometric view of an embodiment of the mating terminal and socket assembly of the present invention contained within a luminaire housing.
Figure 4:
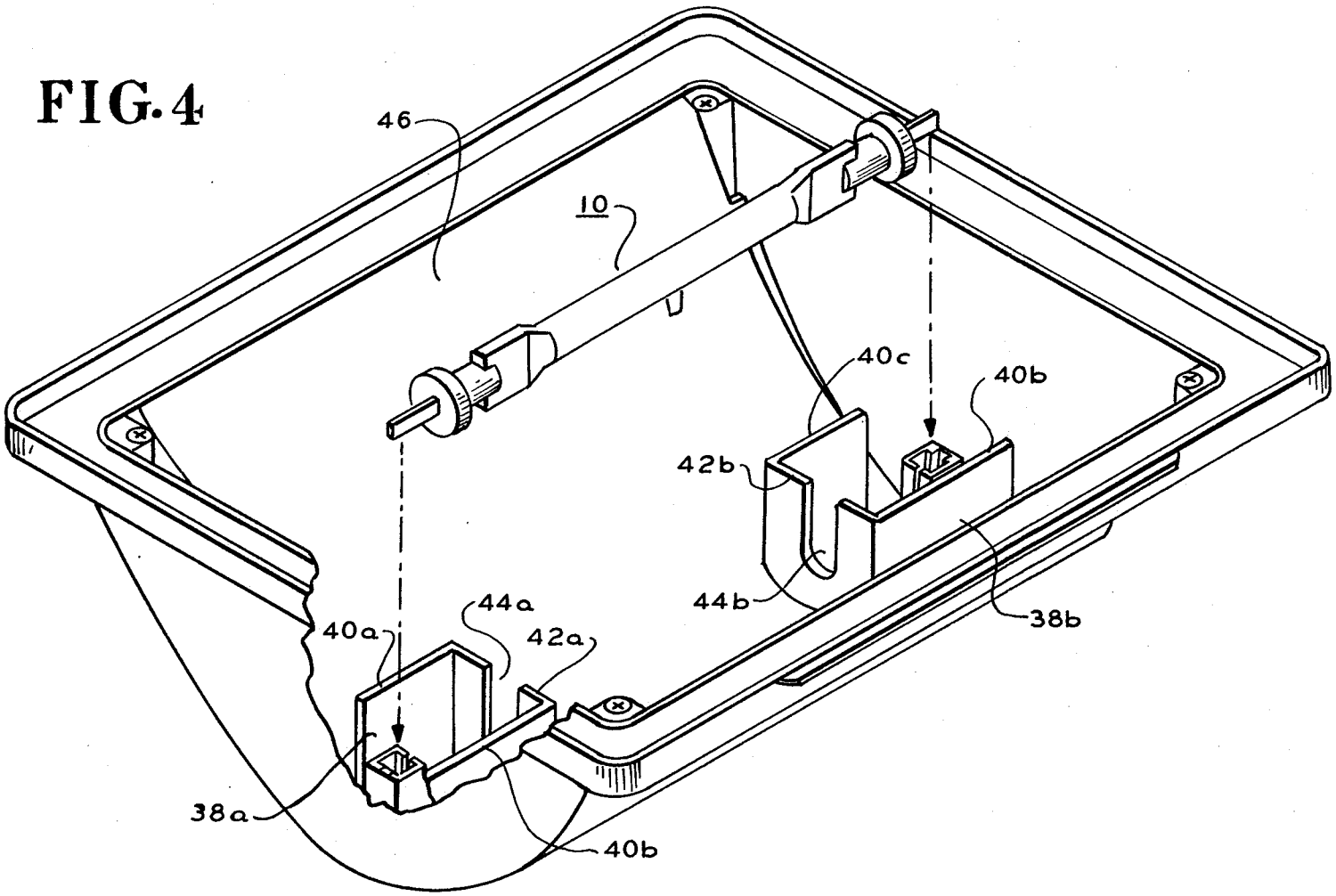
FIG. 4 is an exploded view of an embodiment of the quartz lamp and of a luminaire housing into which fits the quartz lamp.
Figure 5:
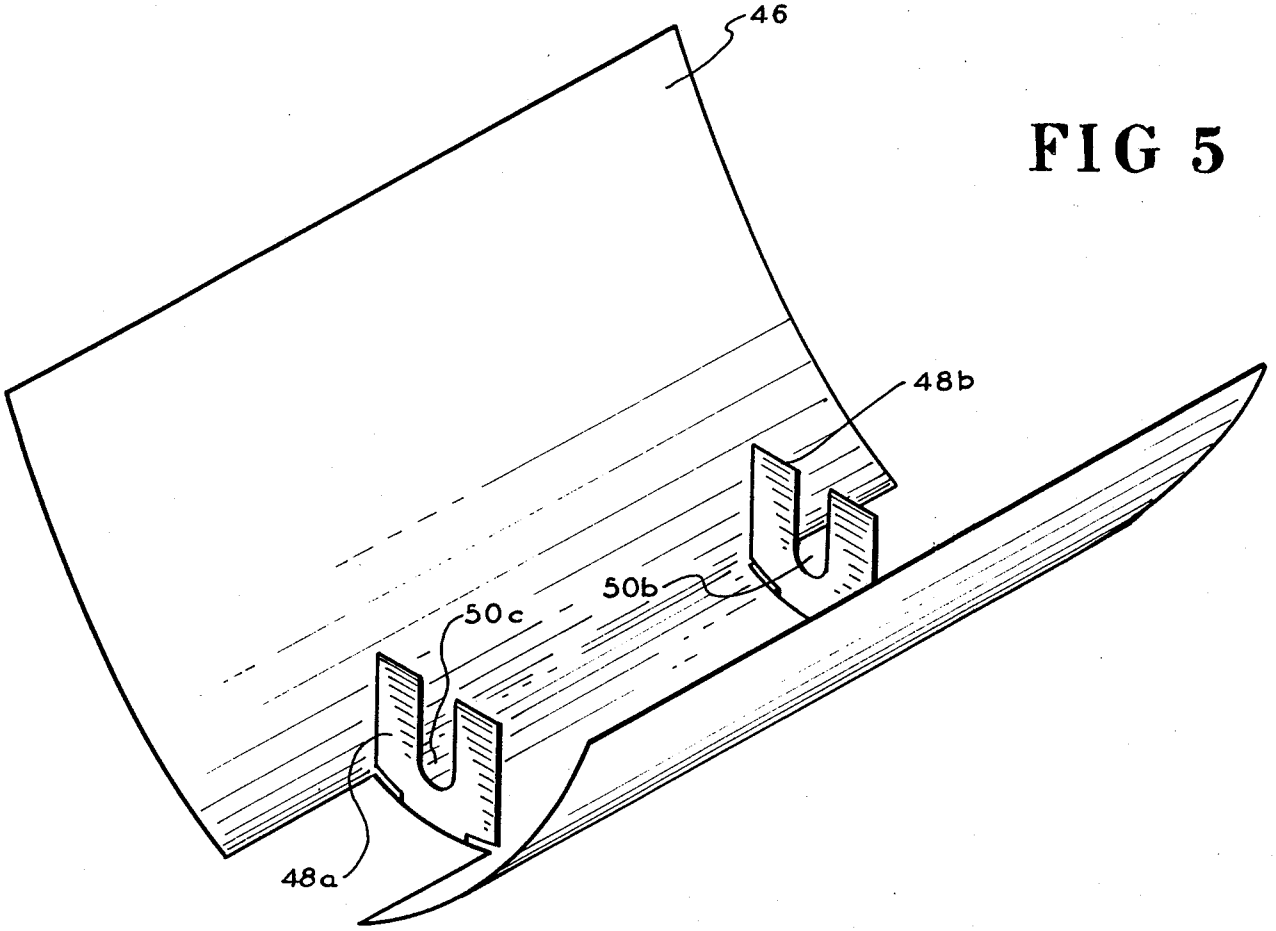
FIG. 5 is an isometric view of an embodiment of a reflector of the present invention.
Figure 6:
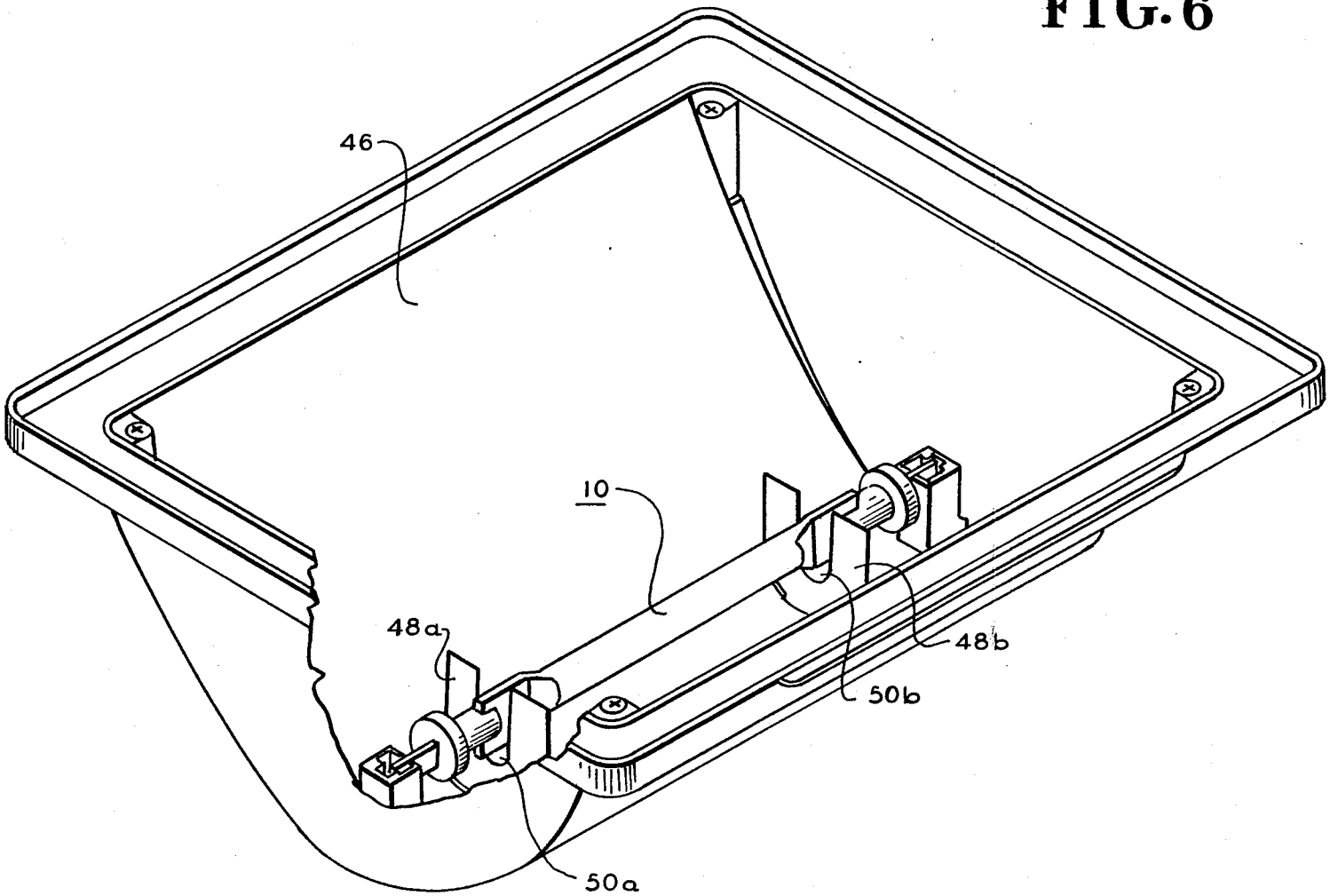
FIG. 6 is an isometric view of the reflector contained within a luminaire.

As shown in FIG. 3, the mating terminal and socket assembly may be contained within a luminaire comprised of a housing 24, and a lens 26 mounted on the front of the housing by any acceptable means known in the art. A preferred means of holding lens 26 on housing 24 is in the form of clip means (not shown), such as described in U.S. Pat. No. 4,410,931.

Surrouding the wedge or prong socket housings 18a and 18b, and the collars 14a and 14b are die-cast heat barriers 38a and 38b. Heat barrier 38a has two walls or panels 40a and 40b extending from the left side of housing 24. Panels 40a and 40b extend parallel to each other and parallel to the quartz lamp to a point past collar 14a. U-shaped wall or panel 42a is perpendicular to panels 40a and 40b, and has a groove 44a for accommodating bulb 12. Heat barrier 38b is similarly constructed. Heat barrier 38b has parallel walls or panels 40c and 40d, and U-shaped panel 42b perpendicular to panels 40c and 40d. U-shaped panel 42b has a groove 44b for accommodating bulb 12. In a preferred embodiment, the panels of heat barriers 38a and 38b are made of aluminum and are from about 0.090 to about 0.100 inch thick. Heat barriers 38a and 38b serve to dissipate heat generated by the quartz lamp as well as to block off radiated heat.

Fixed to the rear of housing 24 is reflector 46. Reflector 46 is also preferably made of aluminum and preferably at least about 0.020 inch thick, and serves to dissipate heat and reflect and radiate light.

As an alternative embodiment, reflector 46 may also include a pair of upwardly extending U-shaped panels 48a and 48b. U-shaped panels 48a and 48b are preferably integral with reflector panel 46. These panels may be used as heat dissipating and heat blocking means in lieu of heat barriers 38a and 38b. U-shaped panels 48a and 48b have grooves 50a and 50b respectively, for accommodating bulb 12. U-shaped panels 48a and 48b are located at points between collars 14a and 14b, respectively, and the quartz lamp 12. U-shaped panels 48a and 48b are preferably made of aluminum and are preferably at least about 0.020 inch thick.

An advantage in the use of this type of reflector is that the use of this type of reflector enables one to employ a plastic housing. A die cast plastic heat barrier analogous to heat barriers 38a and 38b would be unacceptable in that it would not be able to dissipate and block the heat generated by the quartz lamp. A plastic heat barrier would most likely be damaged by the heat generated by the quartz lamp, thus damaging the fixture as well as creating a possible safety hazard. An acceptable heat barrier analogous to those shown as 38a and 38b would need to be made of metal and thus would require separate metal heat barriers to be affixed to the plastic housing. Applicants have discovered that a reflector 46 having U-shaped panels 48a and 48b extending upwardly from reflector 46 is effective in dissipating heat and blocking off radiated heat generated by the quartz lamp without the necessity of inserting a separated metal heat dissipating means within a plastic housing.

When one wishes to replace a quartz lamp inside the luminaire, one removes lens 26 from housing 24, and then removes blade terminals 16a and 16b from wedge sockets 20a and 20b. Blade terminals 16a and 16b are then withdrawn through openings 15a and 15b, and slits 15c and 15d, of wedge socket housings 18a and 18b, and the quartz lamp can then be removed from the luminaire housing 24. A new quartz lamp can then be installed in the luminaire housing 24 by inserting the blade terminals 16a and 16b extending outwardly from the bulb 12 of the new lamp, into the wedge sockets 20a ad 20b as previously described above. After installation of the quartz lamp, the lens 26 can then be re-mounted on the front of luminaire housing 24. By virtue of the mating terminal and socket assembly described above, luminaire quartz lamps become considerably easier and safer to install and replace than those currently used in the art.

In addition, the following advantages are also noted. The outwardly extending blade terminals 16a and 16b serve to dissipate the heat generated by the quartz lamp bulb 12 when the bulb 12 is operating. This results in lower operating temperatures for wedge socket means 20*a* and 20*b*. This provides for improved electrical contact reliability at the junction of blade terminal 16*a* with wedge socket 20*a* and also at the junction of blade terminal 16*b* with wedge socket 20*b* as well as improved reliability between wedge sockets 20*a* and 20*b* and wires 22*a* and 22*b*. In addition, because there is a lower operating temperature for the wedge sockets 20*a* and 20*b*, the wedge socket housings 18*a* and 18*b* may be made of plastic, which is less expensive than a metal housing. A plastic socket housing can also be molded to an exact design specification if necessary. Thus, the mating terminal and socket assembly of Applicants' invention results in a more simplified electrical connection between the blade terminal and the socket. Also, because the wedge sockets 20*a* and 20*b* are movable, in response to expansion and contraction of the quartz lamp 12, within the socket housings 18*a* and 18*b*, the life of the blade terminals 16*a* and 16*b*, as well as of wedge sockets 20*a* and 20*b*, is prolonged because arcing and pitting of the sockets and terminals are prevented. One therefore does not have to replace quartz lamps as often.

The provision of collars 14*a* and 14*b* between flattened end portions 13*a* and 13*b* of bulb 12 and blade terminals 16*a* and 16*b* provides for a further dissipation of heat from bulb 12. The head portions 34*a* and 34*b* of ceramic collars 14*a* and 14*b* facilitate removal and insertion of the quartz lamp as well as providing for even further dissipation of heat. Applicant's invention therefore provides a mating terminal and socket assembly for a quartz lamp which generates less heat while providing for a better and more secure electrical contact between the terminal and the socket.

It is to be understood, however, that the quartz lamp as well as the mating terminal and socket assembly of the present invention is not to be limited to the specific embodiment described above. The number of terminal means and socket means may vary and still remain within the scope of the invention. The mating terminal and socket assembly may also be used in connection with elelctrical fixtures and apparatuses other than luminaires and be used with lamps other than gaseous discharge lamps and quartz lamps. The invention may be practiced other than as particularly described and still be within the scope of the accompanying claims.

What is claimed is:

1. An apparatus, comprising:

a quartz lamp, said quartz lamp containing a filament therein;

at least one terminal means connected to and extending outwardly from said quartz lamp, said at least one terminal means being electrically connected to said filament;

at least one housing, said housing including an opening, said terminal means extending through said opening into said housing;

at least one prong socket means within said housing receiving and gripping said at least one terminal means, said at least one prong socket means being supported by and movable within the housing to move with the quartz lamp as the quartz lamp expands and contracts; and electrically conductive means connected to said at least one prong socket means.

2. The apparatus of claim 1 wherein said apparatus includes two terminal means and two prong socket means.

3. The apparatus of claim 1 wherein said electrically conductive means is a wire.

4. The apparatus of claim 1 wherein said at least one housing is made of a plastic material.

5. The apparatus of claim 1 wherein said quartz lamp includes an elongated bulb; and at least one collar having a first end portion and a second end portion, said at least one collar being made of a ceramic material, said collar fitting over said bulb at said first end portion and adjusted to said at least one first terminal means at said second end portion.

6. The apparatus of claim 5 wherein said second end of said collar is an enlarged head portion adjusted to said at least one first terminal means.

7. The apparatus of claim 1 wherein said at least one terminal means is of a flat, bladelike configuration.

8. The apparatus of claim 1 wherein said prong socket means comprises:

two prongs, each of said prongs upwardly extending from said electrically conductive means, each of said prongs comprising:

a first portion extending upwardly and inwardly angularly from said electrically conductive means;

a second portion extending vertically upwardly from said first portion; and a third portion extending upwardly and angularly outwardly from said second portion.

9. The apparatus of claim 8 wherein said second portions of said upwardly extending prongs touch each other when said prong socket means are not receiving and gripping said terminal means.

10. The apparatus of claim 1 wherein said lamp is a quartz halogen lamp.

11. A luminaire, comprising:

a housing;

a lens attached to the front of said housing;

a quartz lamp, said quartz lamp including a filament therein; and a mating terminal and socket assembly contained within said housing, said mating terminal and socket assembly comprising:

at least one terminal means connected to and extending outwardly from said lamp;

at least one prong socket housing including an opening, said terminal means extending through said opening into said housing;

at least one prong socket means within the prong socket housing receiving and gripping said at least one terminal means, said at least one prong socket means being supported by and movable within the housing to move with the quartz lamp as the quartz lamp expands and contracts; and electrically conductive means connected to said at least one prong socket means.

12. An apparatus, comprising:

a quartz lamp wherein said quartz lamp is an elongated bulb having two ends;

two collars, each of said collars being made of a ceramic material, each of said collars having a first end portion and a second end portion, said first end portion being attached to an end of said bulb by fitting over an end of said bulb;

first and second prong socket housings, each including an opening;

two terminals, each of said terminals being of a bladelike configuration and each of said terminals being attached to a second end portion of each of said collars, each of said terminals extending outwardly from one of said collars, one of said terminals extending into the first prong socket housing through the opening therein, and the other of said terminals extending into the second prong socket housing through the opening therein;

first and second prong socket means within the first and second prong socket housings, each of said prong socket means receiving and gripping one of said terminals, and each of said first and second prong socket means being supported by and movable within first and second prong socket housings, respectively, to move with the quartz lamp as the quartz lamp expands and contracts; and electrically conductive means connected to each of said prong socket means.

13. The apparatus of claim 12 wherein said second end portions of said collars are enlarged head portions.

14. An apparatus, comprising:

a female socket housing;

a female socket terminal within the housing for receiving and gripping a male terminal;

electrically conductive means connected to the female socket terminal;

a quartz lamp, said quartz lamp containing a filament therein; and at least one male terminal means connected to and extending outwardly from said quartz lamp, said at least one male terminal means being electrically connected to said filament, said at least one male terminal means extending into the housing through an opening therein and being received and gripped by the female socket terminal to form an electrical connection point, said female socket terminal being supported by and movable within the housing to move with the quartz lamp upon expansion and contraction the quartz lamp.

15. The apparatus of claim 14 wherein said apparatus comprises two female socket terminals and two male terminal means.

16. The apparatus of claim 14 wherein said quartz lamp includes a elongated bulb; and at least one collar having a first end portion and a second end portion, said at least one colla being made of a ceramic material, said collar fitting over said bulb at said first end portion and adjusted to said at least one male terminal means at said second end portion.

17. The apparatus of claim 16 wherein said second end of said collar is an enlarged head portion adjusted to said at least one male terminal means.

18. The apparatus of claim 14 wherein said at least one male terminal means is of a flat, bladelike configuration.

19. A luminaire, comprising:

a housing;

a lens attached to the front of said housing;

a quartz lamp, said quartz lamp including a filament therein; and a mating terminal and socket assembly contained within said housing, said mating terminal and socket assembly comprising:

at least one female socket housing;

at least one female socket terminal within the female socket housing for receiving and gripping a male terminal;

electrically conductive means connected to each of said at least one female socket terminals; and at least one male terminal means connected to and extending outwardly from said quartz lamp, said at least one male terminal being electrically connected to said filament, said at least one male terminal extending into the female socket housing through an opening therein and being received and gripped by said at least one female socket terminal to form at least one point of electrical connection, said at least one female socket terminal being supported by and movable within the housing to move with the quartz lamp as the quartz lamp expands and contracts.

20. The luminaire of claim 19 wherein said quartz lamp includes an elongated bulb; and at least one collar having a first end portion and a second end portion, said at least one collar being made of a ceramic material, said collar fitting over said bulb at said first end portion and adjusted to said at least one male terminal means at said second end portion.

21. The luminaire of claim 20 wherein said second end of said collar is an enlarged head portion adjusted to said at least one male terminal means.

22. The luminaire of claim 19, and further comprising a reflector, said reflector comprising a base panel and at least one U-shaped panel extending upwardly from said base panel, said at least one U-shaped panel capable of accommodating said quartz lamp, and said at least one U-shaped panel being located inward of said at least one point of electrical connection between said at least one male terminal and said at least one female socket terminal.

* * * * *